United States Patent [19]

Zilka

[11] 4,274,918

[45] Jun. 23, 1981

[54] BLADE CONVEYER FOR A CONTINUOUSLY OPERATING DIGESTER OF THE BAUER M AND D TYPE

[75] Inventor: Ladislav Zilka, Bratislava, Czechoslovakia

[73] Assignee: Vyskumny ustav papieru a celulozy, Bratislava, Czechoslovakia

[21] Appl. No.: 35,388

[22] Filed: May 2, 1979

[30] Foreign Application Priority Data

Sep. 28, 1978 [CS] Czechoslovakia ..... 6272-78

[51] Int. Cl.[3] ..... D21C 7/00

[52] U.S. Cl. ..... 162/237; 162/243

[58] Field of Search ..... 162/17, 57, 59, 237, 162/243; 198/698, 699, 716; 209/252, 272, 350, 361; 210/398, 415; 422/229, 233

[56] References Cited

U.S. PATENT DOCUMENTS

| | | | |
|---|---|---|---|
| 2,559,257 | 7/1951 | Obey | 198/716 |
| 2,966,215 | 12/1960 | Durkee | 162/237 |
| 3,135,651 | 6/1964 | Starrett | 162/237 |
| 3,150,038 | 9/1964 | Rich | 162/237 |

*Primary Examiner*—Peter Chin

*Attorney, Agent, or Firm*—Burgess, Ryan and Wayne

[57] ABSTRACT

A blade conveyer for a digester of the Bauer M and D type, adapted particularly for treating of wood chips and similar material in the manufacture of cellulose, which is provided with blades with openings enabling passage of the boiling liquid substantially uniformly through the whole space between adjacent blades, securing thus a uniform treatment of the treated material and an efficient performance at different conditions of filling and thus an easy adjustment to conditions of other elements of a manufacturing line.

3 Claims, 11 Drawing Figures

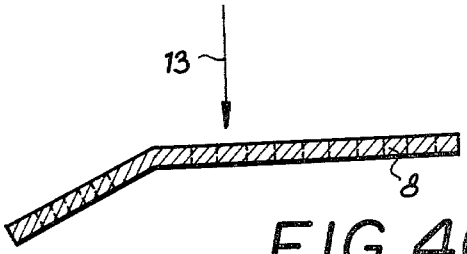
FIG. 4C
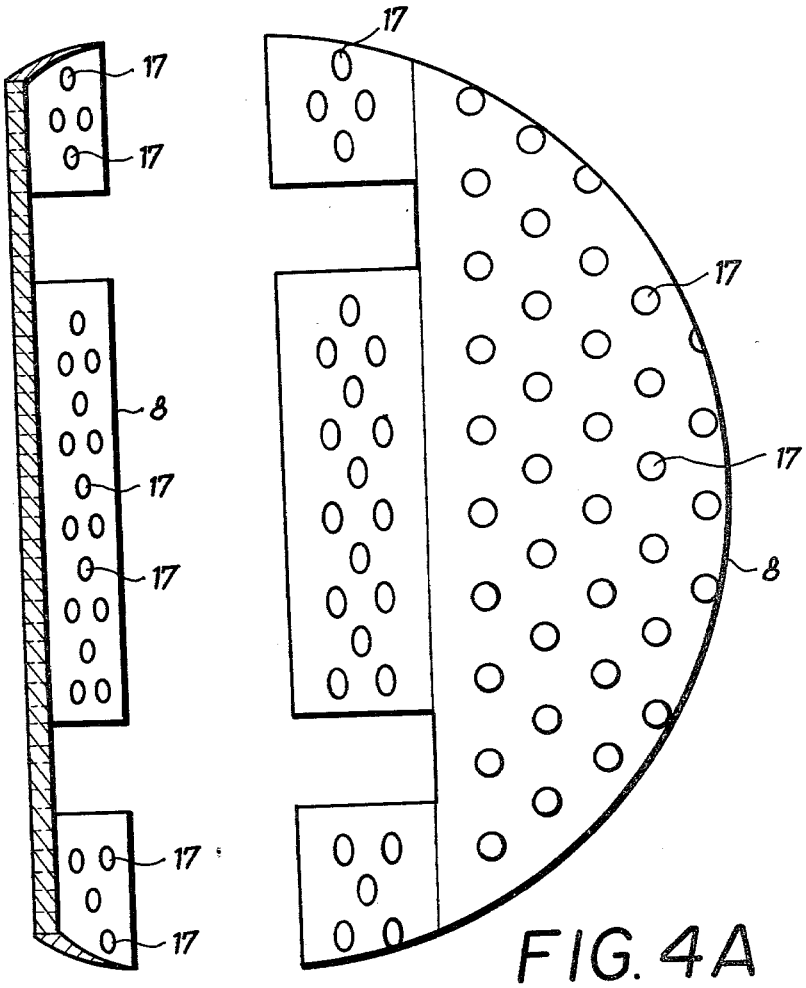
FIG. 4A
FIG. 4B

BLADE CONVEYER FOR A CONTINUOUSLY OPERATING DIGESTER OF THE BAUER M AND D TYPE

BACKGROUND OF THE INVENTION

The invention relates to the design of a blade conveyer within a continuously operating digester of the Bauer M and D type, adapted for boiling processes particularly in the manufacture of cellulose.

The digester of the Bauer M and D type is a highly efficient arrangement designed for co-current continuous boiling processes. The digester proper is enclosed in a longitudinal cylindrical or tubular steel vessel, which is inclined with respect to a horizontal base plane. The internal space of the digester is divided into two parts by a partition wall passing through the longitudinal axis of the vessel—an upper part and a lower part. An endless blade conveyor is situated within the digester along its whole length, advancing in the upper part thereof downwards and in the lower part upwards. A supply port for the material to be treated is near the top of the vessel in its upper part, where the blade conveyer moves downwards. An outlet port for the treated material is near the top of the vessel in its lower part where the blade conveyer moves upwards.

The boiling liquid, for instance water or lye is supplied into the vessel by means of proper feeding means and the level of the boiling liquid is maintained constant in the course of operation. The level of the boiling liquid reaches as a rule up or close to the level of the outlet port for the treated material. The boiling liquid thus occupies both parts of the vessel of the digester, whereby part thereof leaves the digester together with the treated material over the outlet port.

The operating or boiling space between the blades of the advancing blade conveyor is filled through the supply port with the material to be treated by means of a continuously operating dosing device. The degree of filling of the working space by the material determines the maximum performance of the digester at the respective speed of the blade conveyor. The maximum degree of filling of the working space is about 85 percent. A lowering of the performance of the digester can be achieved by lowering the degree of filling of the working space with the material below 85 percent.

Investigations of technological properties of digesters of the Bauer M and D type showed that the boiling conditions in the digester can be in addition to other values characterized by two hydromodules, by a static and dynamic one. The static hydromodule can be defined as the ratio of the weight of the absolutely dry raw material supplied to the boiling space and of the weight of the boiling liquid, which both are simultaneously present in the working space of the digester. The static hydromodule has some similarity with the hydromodule of classical discontinuous digesters, where it characterises conditions when starting the process. The dynamic hydromodule can be defined as the ratio of the weight of the absolutely dry material and of the weight of the boiling liquid supplied to the digester within a certain time interval. The concentration of the liquor on the output from the digester depends on the value of the dynamic hydromodule.

It has been found by measurements and by calculations, that there are mutual relations between the degree of filling of the working space and the static and dynamic hydromodules. For instance in case of a maximum filling of the working space at 85 percent, i.e. at the maximum performance of 100 percent of the digester, the static hydromodule is 1:4.8. By reduction of filling of the digester the value of the static hydromodule increases within the digester, i.e. the ratio between the weight of the material and of the boiling liquid is reduced. At a degree of filling of 42.5 percent of the digester, i.e. at a 50 percent performance, the static hydromodule is already very high, about 1:10.8.

In case of a uniform advance of the treated material and of the boiling liquid with the same forward speed in the digester, the static and dynamic hydromodules are equal, as follows from the design of the digester. Optimum conditions of boiling processes however require a lower dynamic hydromodule, mostly within 1:2.0 to 1:2.5, possibly also up to 1:3.0. In order to obtain the required low hydromodule, a movement of the content of the digester of the Bauer M and D type has to be assured, where the advance of the material is quicker than the advance of the boiling liquid. Particular relations of flows of the boiling liquid in the digester are originating. If we consider the ratio of volumes of components in the digester, for instance in the case of an aqueous initial hydrolysis of beech chips, than in case of a filling of the digester to 85 percent at a static hydromodule equal to 1:4.8 and a dynamic hydromodule equal to 1:2.5, the advance speed of the chips in the digester is nearly twice the speed of the liquid. In case of a half performance of the digester, i.e. at a degree of filling 42.5 percent at a static hydromodule 1:10.8 and a dynamic hydromodule 1:2.5, the advance speed of the chips is already 4.3 times quicker than the advance speed of the liquid. These advance speeds correspond to a straight line flow parallel with the digester axis through cross sections which are proportional to the volume portion of materials in the digester. As however the liquid has at different speeds of the material and liquid only the possibility to flow over gaps between the blades of the conveyor and the internal wall of the vessel of the digester at the circumference of the blades, the maximum advance speed of the liquid is at places of the throughflow higher than considered and the difference of speed is still higher than above mentioned. A consequence of these particular conditions of liquid flow in the digester is the localisation of the intensive flow of the liquid along the circumference of the blades of the blade conveyor, taking along the material. On the other hand the flow of liquid through the material situated in the center of the blades is rather slight. The non-uniform flow of the boiling liquid causes a non-uniform diffusion process in the course of boiling, a non-uniform heat passage between the liquid and solid phase and the transfer of the granular material into the gap between the blades and the wall of the vessel of the digester, which material is rubbed off against this wall, whereby part of the granular material slides over into the following space between the blades and the time interval of its boiling is prolonged. These conditions of flow of the boiling liquid and their consequences can cause a certain irregularity of the boiling process and in case of cooperation of further conditions cause technological troubles.

When increasing the value of the dynamic hydromodule it is in principle possible to reduce the mentioned irregularities of flow of the boiling liquid, however a high dynamic hydromodule means an increased amount of boiling liquid, an increase of power consumption and reduced concentration of liquor, enhancing thus the rentability of the subsequent working or regeneration of liquor, so that this method of operation of the digester cannot be recommended for continuous operation.

This drawback of the digester is caused by the circumstance, that only a small gap is formed between the wall of the vessel of the digester and the circumference of the blades, so that a substantially closed space is created between adjacent blades, where the material together with the boiling liquid is at a certain ratio advanced toward the outlet port. At these conditions a low dynamic hydromodule can be obtained only in that the boiling liquid passes from one space between adjacent blades to the following one by way of gaps between the circumference of the blade and the wall of the digester vessel. Thus the already mentioned irregularity of flow is caused.

SUMMARY OF THE INVENTION

It is an object of this invention to provide means for a more effective and more uniform flow of the boiling liquid in a digester of the Bauer M and D type, so that the treated material would come more uniformly in touch with the boiling liquid. According to this invention the blades of the endles blade conveyor are provided with openings allowing the passage of the boiling liquid from one side of the blade to the other one, preventing however the passage of the treated bulk or granular material. The blades take therefore the function of a sieve or of a filter. The diameter of the openings should be smaller than the diameter of particles of the treated material. For treating of common wood chips openings bored perpendicularly to the surface of the blades of a diameter of 7 to 12 mm at distances of 30 to 40 mm are suitable. The level of the boiling liquid is simultaneously maintained somewhat lower than the level of the outlet port for the material in order to utilize better the separating effect of the blades.

By this perforation of the blades a uniform flow of the boiling liquid is obtained even in case of a substantially different static and dynamic hydro-module. The flow of the boiling liquid in the layer of material in the space above the center of the blade is increased. Due to the improvement of flow conditions the mixing of the boiling liquid is improved, the diffusion is speeded up and is more uniform and the whole boiling process becomes more uniform. By elimination of spaces with a negligible flow of the boiling liquid a local collection and settling of decomposition products is prevented, creating thus conditions for prevention of possible technological problems. The perforation of blades enables to select an arbitrary low degree of filling of the digester with treated material below 50 percent with a simultaneous low dynamic hydromodule up to 1:2.0 and uniform technological conditions.

DESCRIPTION OF DRAWINGS

The attached drawings show conditions of operation of digesters of the Bauer M and D type and improvements according to this invention.

FIGS. 4A, 4B, and 4C are a top view, a side view and a section, respectively, of a blade.

DESCRIPTION OF PREFERRED EMBODIMENTS

Figure 1:
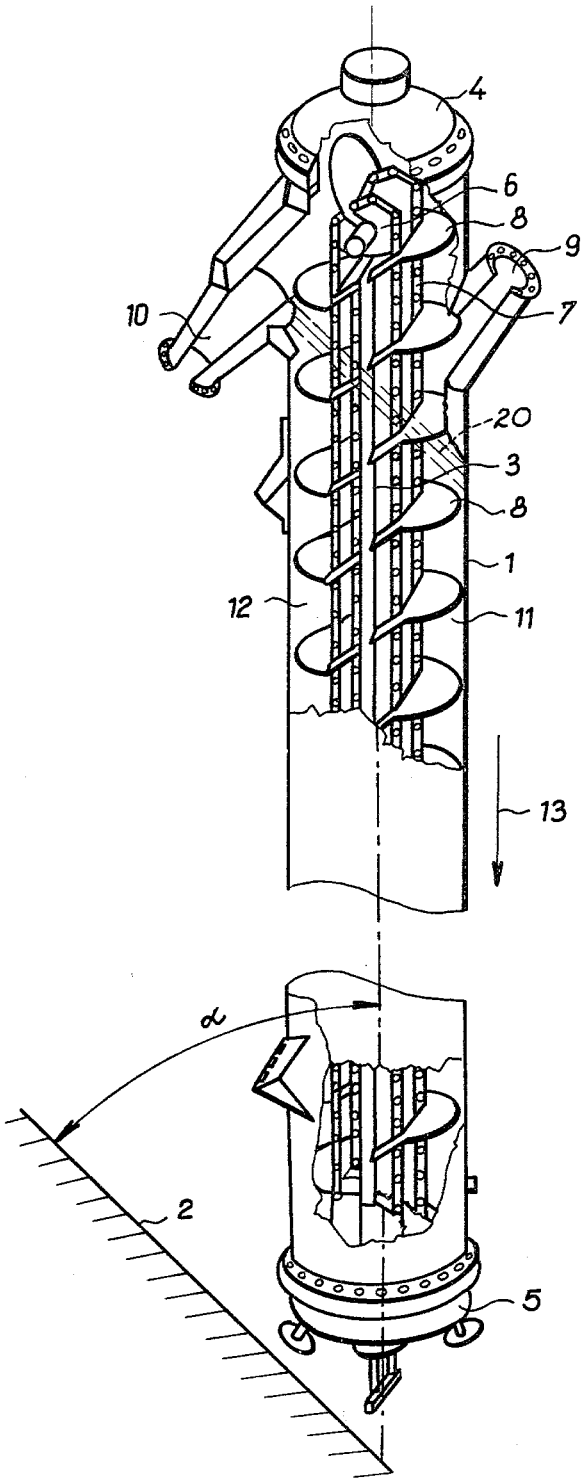
FIG. 1 is a longitudinal, partly sectional view of a digester of the Bauer M and D type.

Referring first to FIG. 1 showing a digester of the Bauer M and D type, this digester comprises a cylindrical or tubular steel vessel 1, the longitudinal axis of vessel 1 being at an acute angle $\alpha$ against a horizontal base plane 2. The internal space of vessel 1 is divided by a partition wall 3 passing through the axis of vessel 1 to an upper part 11 and to a lower part 12. Both ends of vessel 1 are closed by an upper cover 4 and by a lower cover 5 respectively. An endless blade conveyor 6 is situated in both said parts 11 and 12 of vessel 1, said blade conveyor 6 moving in the upper part 11 of vessel 1 downwards, in the lower part 12 of vessel 1 upwards. The blade conveyor 6 is of common design with an endless chain 7 and a number of blades 8 and is driven at one turning point by not shown driving means. An inlet port 9 for the treated material is near the top of the upper part 11 of the vessel 1, an outlet port 10 is near the top of the lower part 12 of the vessel 1.

In the course of operation, the treated material for instance wood chips, is supplied by way of the inlet port 9 by means of a dosing device, filling the spaces between adjacent blades 8 of the blade conveyor and the internal wall of the vessel 1 of the digester. Simultaneously a boiling liquid is supplied to these spaces so that the level 20 of this liquid remains close to the level of the outlet port 10 of the digester. The blade conveyor is in operation advancing in the upper part 11 of the digester downwards, in the lower part 12 upwards.

Figure 2:
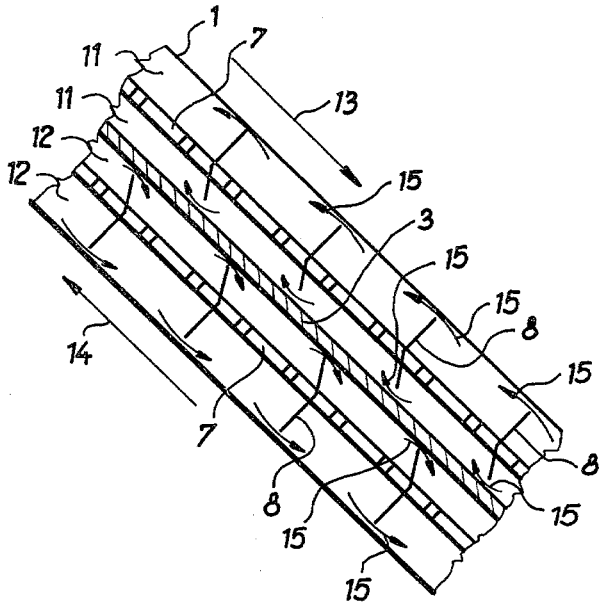
FIG. 2 is a sectional view of a part of the digester showing the flow of the boiling liquid at unperforated blades of the blade conveyor.

FIG. 2 shows flow conditions within the digester if the blades 8 of the blade conveyor are not perforated. The arrow 13 indicates the direction of advance of the blade conveyor 6 in the upper part 11 of the digester, the arrow 14 in the lower part 12 of the digester. The boiling liquid has in this case the only possibility to pass in the upper part 11 of the digester upwards against the direction of advance of the material which is treated over gaps between the circumferences of the blades 8 of the blade conveyor and the internal wall of the vessel 1 of the digester and the partition wall 3 respectively. The same holds true for the lower part 12 of the digester in the opposite direction. The passage of the boiling liquid is indicated by arrows 15.

Figure 3:
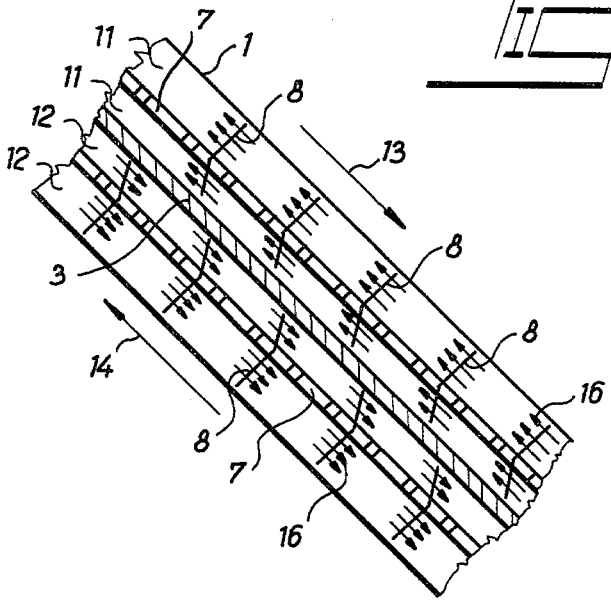
FIG. 3 is a similar view with perforated blades of the blade conveyor.

FIG. 3 shows conditions if perforated blades 8 of the blade conveyor as shown in FIG. 4 are used. In this case the boiling liquid has the possibility to pass practically through the whole cross section of the upper part 11 and of the lower part 12 of the digester through the material advancing in the spaces between adjacent blades 8, securing thereby a uniform treatment of this material in the course of its passage through the digester. Arrows 16 are showing the directions of this passage.

Figure 5:
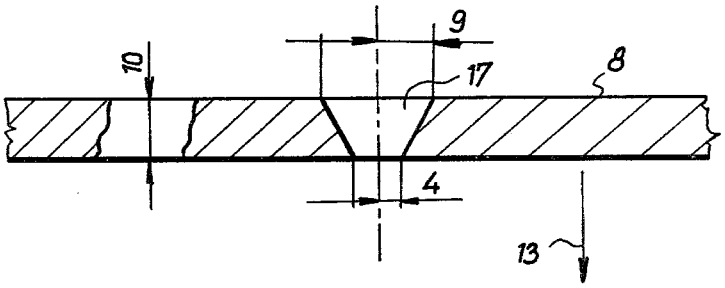
FIG. 5 is a section of a part of a blade with an opening.
Figure 6:
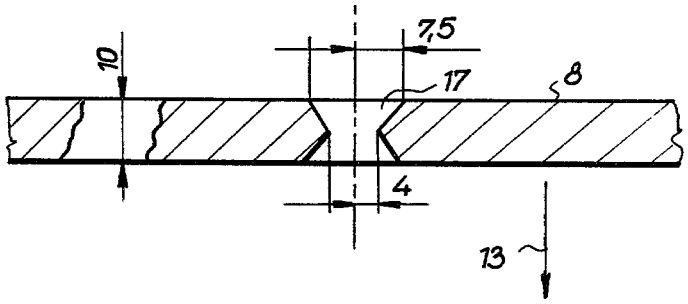
FIG. 6 is another similar view with a different arrangement of openings.
Figure 7C:
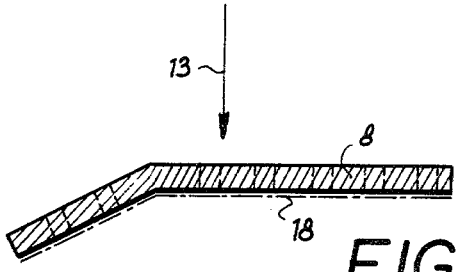
FIGS. 7A, 7B, and 7C are a top view, a side view and a section, respectively, of a blade provided with a sieve.
Figure 7B:
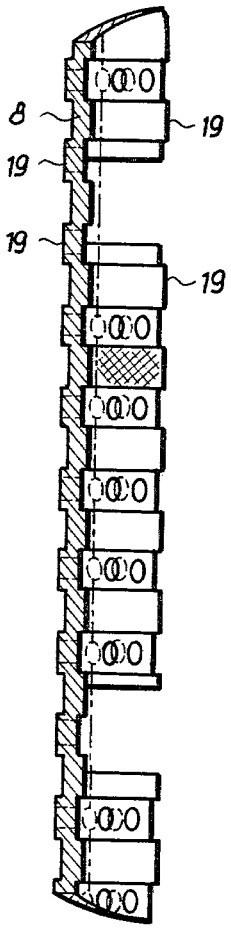
Figure 7A:
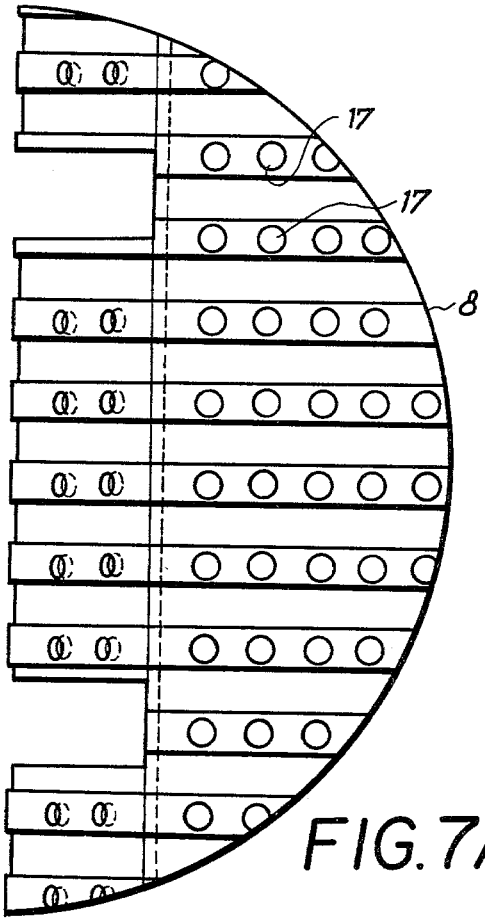

FIG. 4 shows in top view, side view and cross section an exemplary embodiment of a blade 8 of the blade conveyor 6. The blade 8 is made either of sheet material or of cast material and has advantageously in cross section a slightly cranked shape. A number of openings 17 are provided over the whole surface of the blade 8, the diameter of these openings being generally between 7 and 12 mm and their distance between 30 to 60 mm. In order to prevent clogging of these openings 17, it is advantageous to make these openings not cylindrical but as shown in FIG. 5 conical, or as shown in FIG. 6 as double cones narrowing towards the center of thickness of the blade. The size of these openings depends of course on the size of chips which are treated and their diameter should be smaller than the minimum diameter of chips. This arrangement operates satisfactory as long as the treated material does not disintegrate in the course of its passage through the digester, for instance in the case of an aqueous initial hydrolysis of wood chips. If however the treated material is partly disintegrated or contains small particles, this arrangement would fail, as the particles of material would pass together with the boiling liquid through these openings and the boiling conditions would be thereby altered. In that case an arrangement as shown in FIG. 7 can be applied, where the perforated blade 8 is provided with extensions 19 on the surface, in the shape of grooves, knurling, strips, or a corrugated sheet or a grid shaped casting of the shape of a blade is used. A sieve 18 of approximately the same dimensions as the blade 8 is fixed on the surface of the blade facing the direction of advance of the blade conveyor. The openings of the sieve should have a smaller size than the openings 17 of blades 8 and the density of the sieve should be higher than the density of openings of blades. The size of openings of the sieve should be also smaller than dimensions of fibers of the treated material in order to prevent the fibrous suspension to pass through the sieve.

Advantages of the solution according to this invention are primarily in that a uniform boiling process is achieved with an optimum quality of the treated material.

The solution according to this invention enables in case of a substantial reduction of performance of the digester even below 50 percent by reduction of filling of the working space to secure a low dynamic hydromodule and a uniformity of the boiling process. The operation of the digester becomes thus efficient even at a reduced performance, its operation can be easily controlled and adjusted according to technological conditions of other parts of a manufacturing line cooperating therewith.

By application of the object of this invention in the manufacture of cellulose the viscosity of unbleached cellulose is improved, the yield of bleached cellulose is improved and a uniform degree of polymerization of the cellulose is achieved.

I claim:

1. In an apparatus for the continuous digestion of wood chips in the preparation of cellulose comprising an elongated vessel, inclined with respect to a horizontal base plane, having a head end and a tail end divided over a major portion of its length into an upper and lower longitudinally extending blade passage, an endless blade conveyor having apertured blades arranged within the vessel to move downward in the upper blade passage and upward in the lower blade passage, a supply port in communication with the upper blade passage and a discharge port in communication with the lower blade passage, the improvement which comprises blades having conical holes extending through the narrow thickness of the blades wherein the smaller diameter of the conical holes faces in the direction in which the blades move through the apparatus.

2. The apparatus of claim 1 wherein the conical holes are double conical holes having the smaller diameter of the conical holes at a point in the interior of the blades.

3. In an apparatus for the continuous digestion of wood chips in the preparation of cellulose comprising an elongated vessel, inclined with respect to a horizontal base plane, having a head end and a tail end divided over a major portion of its length into an upper and lower longitudinally extending blade passage, an endless blade conveyor having apertured blades arranged within the vessel to move downward in the upper blade passage and upward in the lower blade passage, a supply port in communication with the upper blade passage and a discharge port in communication with the lower blade passage, the improvement which comprises blades having extensions at least on the surfaces which face in the direction in which the blades move through the apparatus and a sieve covering the extensions on the surfaces which face in the direction in which the blades move through the apparatus.

* * * * *